US007053345B2

(12) United States Patent
Fukushi et al.

(10) Patent No.: US 7,053,345 B2
(45) Date of Patent: May 30, 2006

(54) HEATING APPARATUS WITH TEMPERATURE DETECTION SYSTEM FOR IDENTIFYING AND NOTIFYING THE USER THAT THE MATERIAL TO BE HEATED IS WOUND AROUND THE INDUCTION HEATING ELEMENT

(75) Inventors: Kenji Fukushi, Toride (JP); Manabu Yamauchi, Kashiwa (JP); Hiroto Nishihara, Toride (JP); Yasuyuki Aiko, Toride (JP); Hidehiko Kinoshita, Kashiwa (JP); Tomoichirou Ohta, Kashiwa (JP); Takamitsu Hirayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/220,802

(22) Filed: Sep. 8, 2005

(65) Prior Publication Data

US 2006/0006169 A1 Jan. 12, 2006

Related U.S. Application Data

(62) Division of application No. 11/019,131, filed on Dec. 22, 2004.

(30) Foreign Application Priority Data

Dec. 24, 2003 (JP) ..... 2003-427809

(51) Int. Cl.
*H05B 6/14* (2006.01)
*G03G 15/20* (2006.01)

(52) U.S. Cl. ..... 219/619; 219/667; 399/328; 399/330

(58) Field of Classification Search ..... 219/619, 219/672, 663–668; 399/328–338
See application file for complete search history.

(56) References Cited

U.S. PATENT DOCUMENTS

| | | | | |
|---|---|---|---|---|
| 5,365,322 | A | 11/1994 | Hamada et al. | 355/316 |
| 5,942,882 | A | 8/1999 | Ohta | 323/282 |
| 6,188,054 | B1 | 2/2001 | Ohta | 219/663 |
| 6,330,422 | B1 | 12/2001 | Sato et al. | 399/382 |
| 6,603,951 | B1 | 8/2003 | Sato et al. | 399/382 |
| 6,640,064 | B1 | 10/2003 | Kinoshita | 399/69 |
| 6,691,399 | B1 | 2/2004 | Hayashi et al. | 29/605 |

(Continued)

FOREIGN PATENT DOCUMENTS

| | | |
|---|---|---|
| JP | 59-33787 | 2/1984 |

(Continued)

*Primary Examiner*—Philip H. Leung
(74) *Attorney, Agent, or Firm*—Fitzpatrick, Cella, Harper & Scinto

(57) ABSTRACT

A heating apparatus has a magnetic flux generator and a rotatable induction heating element for generating heat through electromagnetic induction by the action of magnetic flux generated by the magnetic flux generator, and heats a material to be heated by causing the material to be heated to contact the induction heating element. The heating apparatus further includes a thermistor for detecting a surface temperature of the induction heating element, power supply circuits for controlling power to be supplied to the magnetic flux generator on the basis of signals from the temperature detection, a Curie temperature reaching detector for detecting that the temperature of the induction heating element reaches the Curie temperature, and control circuits for detecting that the material to be heated is wound around the induction heating element on the basis of signals from the thermistor and the Curie temperature reaching detector.

4 Claims, 14 Drawing Sheets

U.S. PATENT DOCUMENTS

| | | | | |
|---|---|---|---|---|
| 6,782,236 | B1 | 8/2004 | Sasaki et al. | 399/401 |
| 6,804,474 | B1 | 10/2004 | Morita et al. | 399/23 |
| 6,842,592 | B1 | 1/2005 | Kinoshita | 399/69 |
| 2004/0007569 | A1 | 1/2004 | Ohta | 219/624 |
| 2004/0037580 | A1 | 2/2004 | Ohta | 399/69 |

FOREIGN PATENT DOCUMENTS

| | | |
|---|---|---|
| JP | 6-175524 | 6/1994 |
| JP | 8-286542 | 11/1996 |
| JP | 10-104974 | 4/1998 |
| JP | 2000-39797 | 2/2000 |
| JP | 2001-56622 | 2/2001 |
| JP | 2001-267050 | 9/2001 |

HEATING APPARATUS WITH TEMPERATURE DETECTION SYSTEM FOR IDENTIFYING AND NOTIFYING THE USER THAT THE MATERIAL TO BE HEATED IS WOUND AROUND THE INDUCTION HEATING ELEMENT

This application is a divisional of U.S. patent application Ser. No. 11/019,131, filed on Dec. 22, 2004, now pending.

FIELD OF THE INVENTION AND RELATED ART

The present invention relates to an electromagnetic induction heating type heating apparatus for heating an image on a material to be heated. For example, the present invention relates to an electromagnetic induction heating type heating apparatus suitable for a fixing apparatus for heat-fixing an unfixed toner image, which is heat-fusible and is formed on a recording sheet, in an electrophotographic type or electrostatic recording type image forming apparatus, such as a printer or a copying machine.

Heretofore, in an image forming apparatus, such as a fixing apparatus that a toner image which has been formed on a sheet, as a recording medium such as a recording paper or a transfer material, directly or through transfer is fixed on the sheet, has been provided.

As the heating apparatus, e.g., Japanese Laid-Open Patent Application (JP-A) No. Sho 59-33787 has proposed an induction heating type fixing apparatus which utilizes high-frequency induction (heating) as a heat source. In this induction heating type fixing apparatus, a coil is disposed concentrically in hollow fixation roller comprising a metal conductor. A high-frequency current is passed through the coil to generate a high-frequency magnetic field. The magnetic field generates an induction eddy current, whereby the fixing apparatus itself generates Joule heat due to its own skin resistance. According to the induction heating-type fixing apparatus, an electricity-heat conversion efficiency is significantly improved, so that it becomes possible to reduce a warm-up time.

As a kind of paper jam peculiar to a hot roller type fixing apparatus irrespective of heating means, it has been known such a paper jam that paper is wound around a fixation roller due to, e.g., some thickness of the paper when an unfixed toner image is hot-melted by the fixation roller. In this case, the fixation roller has high temperature, so that a user cannot readily remove the jammed paper. Further, when the user removes the jammed paper by force, there is a possibility that the fixation roller is damaged, so that a resultant image quality is affected.

As a mechanism for detecting the above described winding (paper) jam, e.g., JP-A Hei 06-175524 has proposed such a structure that pre-fixing and post-fixing sensors are disposed before and after the fixation roller, respectively, so that a distance between the post-fixing sensor and a fixation portion is smaller than a peripheral (circumferential) length of the fixation roller or a pressure roller and a distance between the pre-fixing sensor and the post-fixing sensor is not larger than a minimum (passing) paper size, thereby to detect the winding of paper around the fixation roller. When the paper is present at a pre-fixing sensor portion and is not present at a post-fixing sensor portion, a central processing unit (CPU) recognizes that the paper is wound around the fixation roller or the pressure roller and then disables the drive of the roller. Further, when the paper is present at the post-fixing sensor portion, the CPU enables the drive of the roller.

However, after the user turns a main switch (SW) of an image forming apparatus off and/or on, the paper once wound around the fixation roller cannot be detected whether it is wound around the fixation roller or not, thus causing such a problem that a fixation characteristic becomes poor during a copying operation.

Further, by the winding of paper around the fixation roller, the paper enters a gap between the fixation roller and the temperature detection mechanism therefor. As a result, there is a possibility that a surface temperature of the fixation roller is erroneously detected.

As an overheating prevention mechanism for the fixation roller in an electromagnetic induction heating type fixing apparatus, e.g., JP-A No. 2001-267050 has proposed that a leakage magnetic flux induction member is disposed outside the fixing apparatus and catches the leakage magnetic flux by utilizing such a property that a permeability of a magnetic member when a temperature of the fixation roller reaches a Curie temperature (Curie point) is abruptly decreased to cause leakage of the magnetic flux from the magnetic member, so that a temperature of a thermoswitch is increased so as to shut-off an electric circuit, thereby to block power-on from a heating means to prevent the overheating of the fixation roller.

However, in the method wherein the leakage magnetic flux is caught to block the power supply from the heating means, the user cannot recognize whether the power-off state is caused by the occurrence of paper winding or not, so that the user successively turns again the power on, thus leading to a complaint about a poor fixation characteristic etc.

Further, the user also completely shuts down the image forming apparatus and then call a service person. In this case, although the paper winding problem can ordinarily be solved by the user, the user has completely shuts down the image forming apparatus without solving the problem.

SUMMARY OF THE INVENTION

An object of the present invention is to provide a heating apparatus which can detect winding of a material to be heated around a heating element by a simple means or sequence and can prevent an occurrence of a fixation failure trouble caused due to the winding.

According to an aspect of the present invention is to provide an image forming apparatus, comprising:

magnetic flux generation means, a rotatable induction heating element for generating heat by the action of magnetic flux generated by the magnetic flux generation means, the induction heating element heating a material to be heated by contacting the material to be heated, wherein the image forming apparatus further comprises Curie temperature reaching detection means for detecting that a temperature of the induction heating element reaches a Curie temperature and temperature detection means for detecting a surface temperature of the induction heating element, and provides notification that the material to be heated is wound around the induction heating element on the basis of signals from the temperature detection means and the Curie temperature defection means.

This and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENT

First Embodiment (1) Embodiment of Image Forming Apparatus

Figure 1:
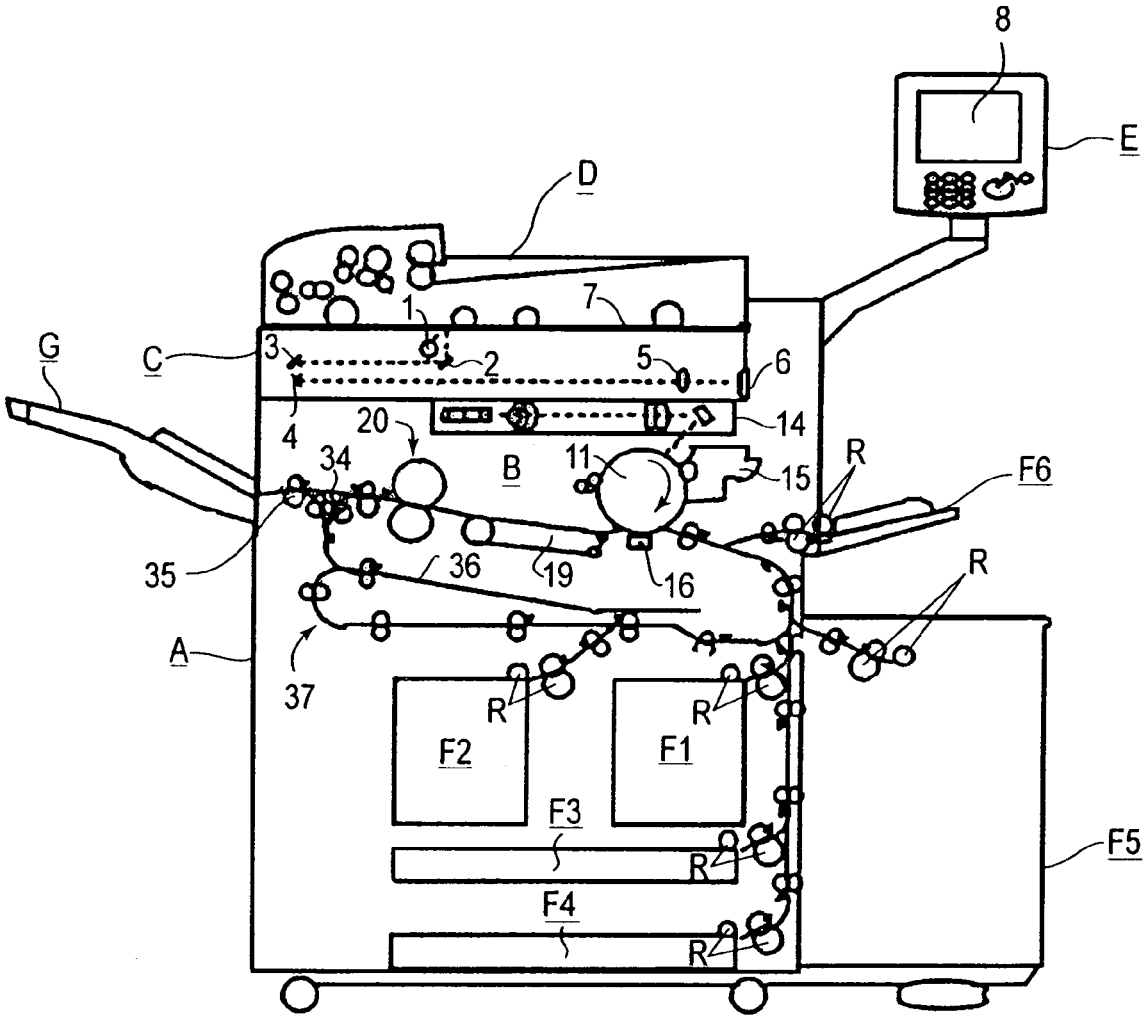
FIG. 1 is a schematic structural view of an embodiment of an image forming apparatus in Embodiment 1 or 2.

FIG. 1 is a schematic structural view of an forming apparatus in this embodiment.

In this embodiment, the image forming apparatus is a digital-type image forming apparatus (a copying machine, a printer, a facsimile machine, a multi-functional machine of these machines, etc.) utilizing a transfer-type electrophotographic process.

Referring to FIG. 1, the image forming apparatus includes an image forming apparatus main assembly A; an electrophotographic image forming portion (main assembly image output portion) B disposed at an approximately upper-half portion in the apparatus main assembly A; an image reader (main assembly input portion) C disposed at an upper portion of the apparatus main assembly A; an automatic document feeder D disposed on the image reader C; a console portion E supported outside the apparatus main assembly via an arm portion; four paper (sheet) feeding cassettes (paper feeding stage) F1–F2, in which various-sized recording sheets are accommodated, disposed at an approximately lower-half portion in the apparatus main assembly A; a large-capacity paper deck F5 which is disposed outside the apparatus main assembly A and is connected with the apparatus main assembly A; a manual (paper) feed tray portion F6 which is disposed outside the apparatus main assembly A in a foldable manner, and an output (discharge) tray portion G which is disposed, opposite from the manual feed tray portion F6, outside the apparatus main assembly A.

The console portion E includes various operation keys and a display portion 8 such as a liquid crystal display or the like, thus permitting a user to perform various operations, such as setting of copying modes by use of the keys and display portion. Further, it is possible to display, e.g., various set values and a current job at the display portion 8.

The image reader C is a digital-type apparatus using moving optical system having a light source 1 and mirrors 2–4, a lens 5, and an image sensor (CCD array) 6. On an original supporting glass plate 7, an original is placed and set face-down by the automatic document feeder D.

The original placed face-down on the original supporting glass plate 7 is irradiated with light from the light source 1 which is scanning-moved in a longitudinal (horizontal) direction in FIG. 1. The light is reflected by the original, and an optical image is formed on the CCD array 6 through the mirrors 2–4 and the lens 5. By the CCD array, the formed image is converted into an electric signal to provide digital image data. The image data are subjected to image conversion, such as scaling, on demand from the user, and then stored in an unshown image memory.

Figure 2:
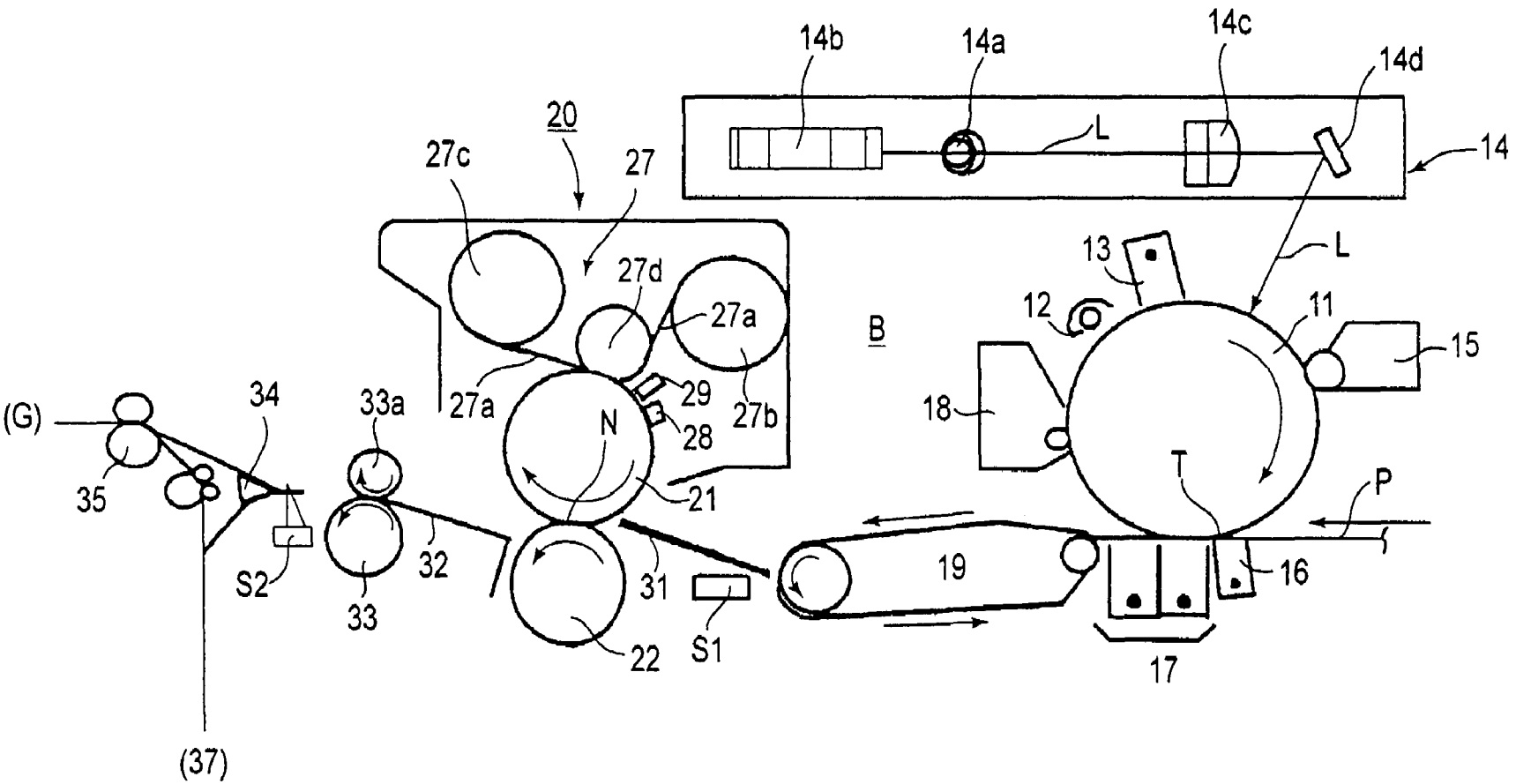
FIG. 2 is a schematic enlarged view of the image forming apparatus shown in FIG. 1 at a transfer portion, a fixation portion and the neighborhood thereof.

The electrophotographic image forming portion B, as shown in FIG. 2 which is a partially enlarged view of FIG. 1, is an electrophotographic process mechanism including a photosensitive drum 11, which is an image bearing member, as a main structural member. The photosensitive drum 11 has a surface photoconductive layer of an organic photoconductor, and is rotationally driven during copying job in a clockwise direction of an indicated arrow at a certain peripheral speed. First, residual electric charge remaining on the photosensitive drum 11 is removed by a pre-exposure apparatus, and then on the photosensitive drum 11, an electric charge is uniformly provided by a primary charger 13. From a laser scanner unit 14, laser beam L which has been modulated in accordance with the digital image data obtained by the above described image reader C is outputted, whereby an electrostatic latent image is formed on the photoconductive layer of the photosensitive drum 11. Thereafter, to the electrostatic latent image on the photosensitive drum 11, toner supplied from a developing device 15 is adhered, whereby the electrostatic latent image is developed into a visual image as a toner image.

With respect to the laser scanner unit 14, during image output, the image data stored in the image memory in the electrophotographic image forming portion B are read out and re-converted from the digital signal to the analog signal, and are outputted from an optical irradiation portion 14*a* as a light signal of the laser beam L. The surface of the photosensitive drum 11 is irradiated with the laser beam L via a scanner (polygon mirror) 14*b*, a lens 14*c*, and a mirror 14*d* to perform scanning exposure.

On the other hand, a paper feed and conveyance roller R of a paper feeding portion which is preliminarily designated for use or selected from the six paper feeding portions F1–F6 including the paper feeding cassettes F1–F4, the large-capacity paper deck F5, and the manual feed tray portion F6, is driven by an unshown motor, whereby one sheet of recording sheet P is separated and fed from the paper feeding portion and conveyed to a transfer portion T, as an opposing portion between the photosensitive drum 11 and a transfer charger 16, through a predetermined sheet conveyance passage (sheet passage). In this case, the recording sheet P is fed to the transfer portion T in synchronism with the toner image formed on the photosensitive drum 11 so that a leading position of the toner image on the photosensitive drum 11 and a leading position of the recording sheet P are aligned with each other in a predetermined manner by a registration roller or a registration sensor disposed in front of the transfer portion T. The transfer charger 16 electrically charges the recording sheet P to transfer the toner image onto the recording sheet P (transfer of the toner image). Thereafter, in order to improve a separative performance of the recording sheet P from the photosensitive drum 11, the recording sheet P is electrically charged by a separation charger 17.

The recording sheet P which has been separated from the photosensitive drum 11 is conveyed into a fixing apparatus 20, which is a heating apparatus of an electromagnetic induction heating type as described later, by a conveyance belt 19 and an unfixed toner image is fixed on the surface of the recording sheet P.

On the other hand, toner remaining on the photosensitive drum 11 without being transferred onto the recording sheet P at the transfer portion T is scraped off the photosensitive drum 11, so that the electric charge on the photosensitive drum 11 is uniformly made zero by a pre-exposure apparatus 18, and the photosensitive drum 11 prepares for a subsequent copying operation.

In the case where a one-sided copying mode is selected, the recording sheet P come out of the fixing apparatus 20 is guided in a direction toward discharge rollers 35 by a flapper 34 and is discharged in the output tray portion G by the discharge rollers 35 as a one-sided copy product.

In the case where a double-sided copying mode is selected, the recording sheet P, which has been subjected to the one-sided copying operation, come out of the fixing apparatus 20 is guided by the flapper 34 in a re-feeding sheet passage 37 including a switch-back conveyance passage 36, and is re-fed from the re-feeding sheet passage 37 to the transfer portion T of the electrophotographic image forming portion B though a predetermined sheet conveyance passage in such a state that the recording sheet P is turned upside down, thus being subjected to transfer of a toner image onto the other surface of the recording sheet P. The recording sheet P after the toner image is transferred onto the other surface thereof is separated from the photosensitive drum 11 and is conveyed again into the fixing apparatus 20 by the conveyance belt 19 to be subjected to the fixing treatment of the toner image on the other surface of the recording sheet P. Thereafter, the recording sheet P come out of the fixing apparatus 20 is guided in the direction toward the discharge rollers 35 by which the recording sheet P is discharged in the output tray portion G as a double-sided copy product.

(2) Fixing Apparatus 20

Figure 3:
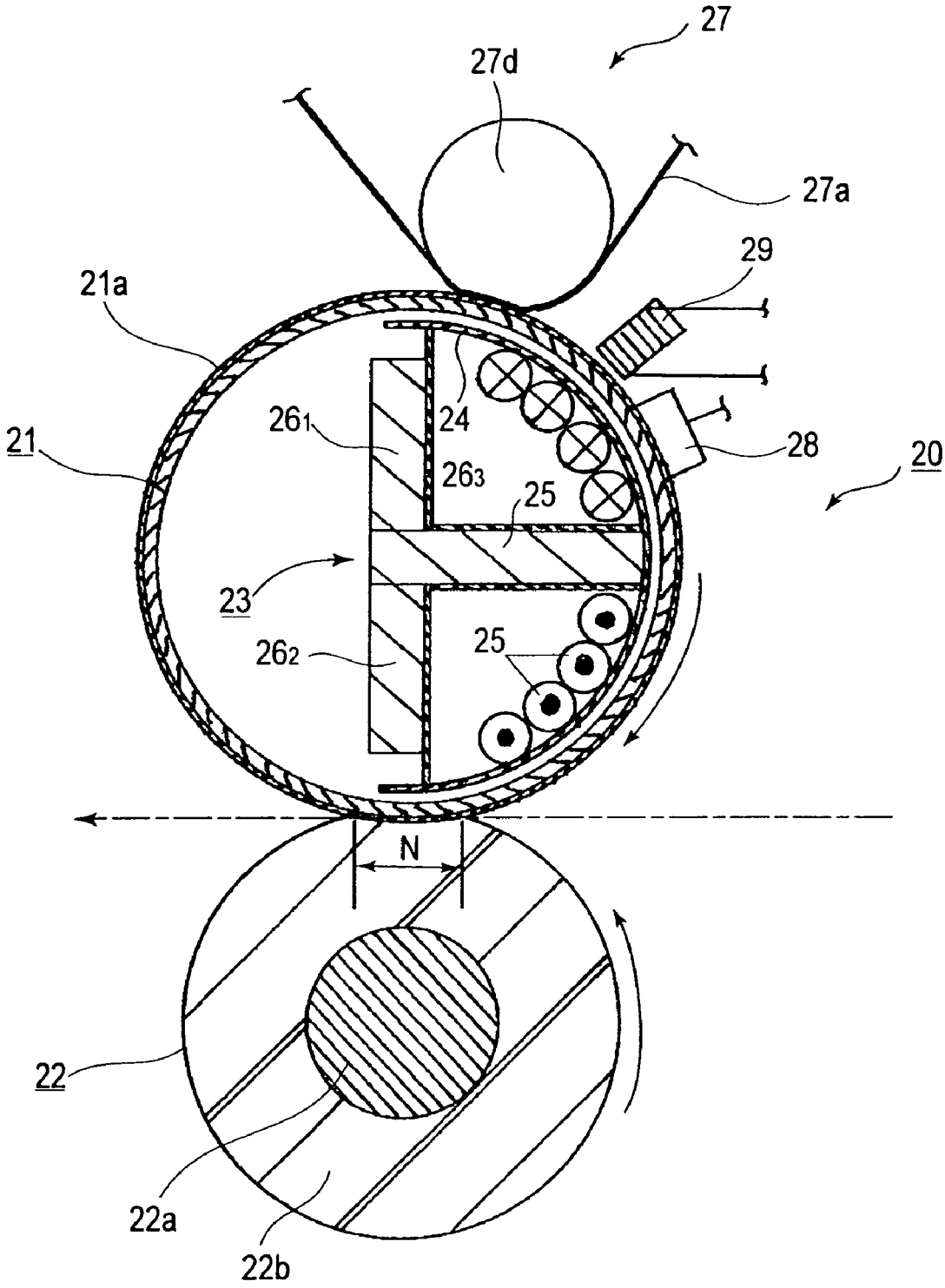
FIG. 3 is an enlarged cross-sectional view of a principal part of a fixing apparatus in Embodiment 1 or 2.

FIG. 3 is a cross-sectional view of a principal portion of the fixing apparatus 20.

This fixing apparatus 20 in this embodiment is of a heating roller type and is a heating apparatus of an electromagnetic induction heating type. The fixing apparatus 20 principally includes a pair of heating roller 21 and a pressure roller 22 which are vertically disposed in parallel and pressed against each other to create a fixation nip portion N as shown in FIGS. 2 and 3.

The heating roller (hereinafter referred to as a "fixation roller") 21 is a hollow (cylindrical) roller which is formed with an induction heating element in a thickness of, e.g., 50–2000 μm. At an outer peripheral surface of the roller, a heat-resistant release layer 21*a* is formed by coating the roller with a fluorine-containing resin etc. The fixation roller 21 is rotatably supported between side plates located on the front and rear sides of the fixing apparatus each via a bearing at both end portions thereof. Further, at an inner hollow portion of the fixation roller 21, an exciting coil unit 23, as a magnetic flux generation means, is injected and fixedly supported in a non-rotational manner.

The pressure roller 22 is an elastic roller including a core metal 22*a*; a heat-resistant elastic layer 22*b*, of a silicone rubber etc., which is integrally and concentrically wound around the core metal 22*a*; and a releasable surface layer formed at an outer peripheral surface of the elastic layer 22*b*. The pressure roller 22 is disposed under and in parallel with the fixation roller 21 and is rotatably held between the side plates located on the front and near sides of the fixing apparatus each via a bearing 26 at both end portions thereof. Either one or both of the fixation roller 21 and the pressure roller 22 are urged under pressure by an unshown urging means while resisting an elasticity of the elastic layer 22*b* of the pressure roller 22, thus forming the fixation nip portion N having the predetermined nip width.

The induction heating element constituting the fixation roller 21 is formed of magnetic metals (electroconductors or magnetic materials), such as nickel, iron, ferromagnetic SUS, iron-nickel alloy, iron-nickel-chromium alloy, and nickel-cobalt alloy; a magnetism-adjusted alloy having an adjusted Curie temperature as desired as disclosed in JP-A No. 2000-39797; etc.

The exciting coil unit 23, as the magnetic flux generation means, inserted into the inner hollow portion of the fixation roller 1 is an assembly of a holder (outer casing) 24, an exciting coil 25, and magnetic cores 261–263. The exciting coil 25 and the magnetic cores 261–263 are incorporated and held in the holder 24. The exciting coil unit 23 is inserted into the hollow portion of the fixation roller 21 and fixedly supported in a non-rotational manner in such a state that it is disposed in a position with a predetermined angle and with a predetermined spacing with respect to the inner surface of the fixation roller 21 in a non-contact manner.

As a suitable material for the holder 24, it is possible to use heat-resistant and nonmagnetic materials, such as PPS-based resin, PEEK-based resin, polyimide resin, polyamide-based resin, polyamideimide-based resin, ceramic, a liquid crystal polymer, and fluorine-containing resin.

The exciting coil 25 is required to generate a sufficient alternating magnetic flux for heating, so that it is necessary to provide a low resistance component and a high inductance component. As a core wire of the exciting coil 25, a litz wire comprising a bundle of about 80–160 fine wires having a diameter of 0.1–0.3 mm. The fine wires comprise an insulating electric cable. The fine wires are wound around the magnetic cores 261–263 plural times along the inner bottom shape of the holder 24 in an elongated board form, thus providing the exciting coil 25.

Figure 4:
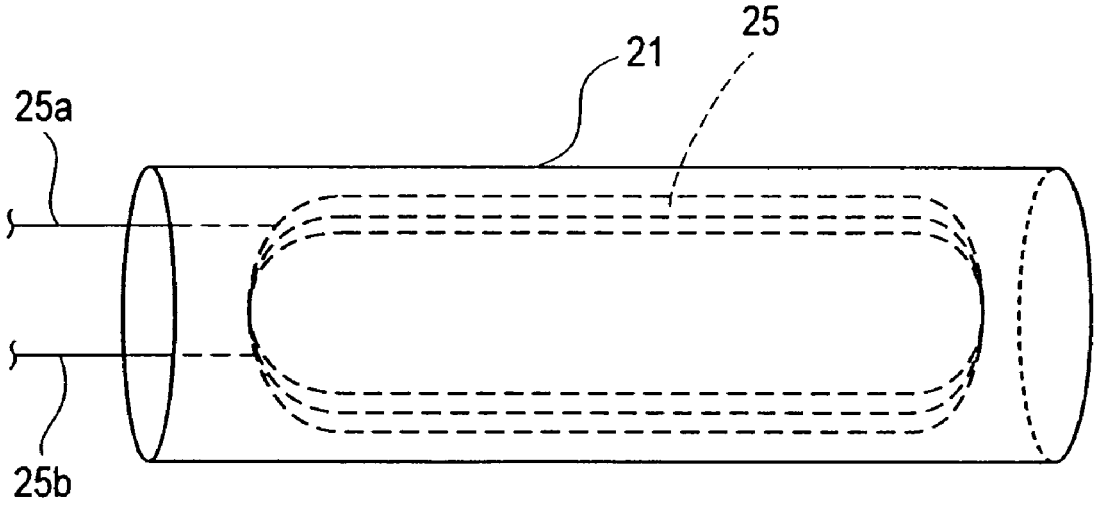
FIG. 4 is a schematic view of a fixation roller and an exciting coil in Embodiment 1 or 2.

The magnetic cores 261–263 are disposed in a T-character shape and formed of, e.g., a high-permeability member, such as ferrite permalloy, which may preferably be selected from low-loss materials. The exciting coil 25 is wound in a longitudinal direction of the fixation roller 21 as shown in FIG. 4, and is held by the inner wall of the holder 24 and the magnetic cores 261–263. The exciting coil 25 has two lead-out wires 25*a* and 25*b* connected to a power supply circuit.

A fixation roller cleaner 27 includes a cleaning web 27*a*, a web feeding axis portion 27*b* which holds the cleaning web 27*a* in a roll shape, a web take-up axis portion 27*c*, and a pressing roller 27*d* for pressing the web portion between the both axis portions 27*b* and 27*c* against the outer surface of the fixation roller 21. By the web portion pressed against the fixation roller 21 by use of the pressing roller 27*d*, offset toner on the fixation roller 21 surface is wiped out to clean the fixation roller 21 surface. The web portion pressed against the fixation roller 21 is gradually renewed by feeding the web 27*a* little by little from the feeding portion 27*b* to the take-up portion 27*c*.

A thermistor 28 as a temperature detection means and a magnetic coil 29 as a Curie temperature (Curie point) reaching detection means of the fixation roller 21 are disposed, outside the fixation roller 21, downstream from a contact portion of the cleaning web 27*a* of the fixation roller cleaner 27 with the fixation roller 21 in the rotation direction of the fixation roller 21. The thermistor 28 is disposed so that it is pressed against the surface of the fixation roller 21 by an elastic member to electrically contact the fixation roller 21. The magnetic coil 29 is disposed closely opposite to the surface of the fixation roller 21 in a non-contact manner. The thermistor 28 and the magnetic coil 29 may preferably be close to each other but may be apart from each other. The temperature detection means 28 is not limited to the thermistor so long as it is a temperature detection element. Further, the thermistor may be of a contact type or a non-contact type. In this embodiment, the contact-type thermistor is described as an example.

A front guide plate 31 disposed before the fixation roller 21 guides the recording sheet P, which has been conveyed from the conveyance belt 19 to the fixing apparatus 20, to an entrance portion of the fixation nip portion N.

A rear guide plate 32 disposed after the fixation roller 21 guide the recording sheet P, which has come out of an outlet portion of the fixation nip portion N, to a fixation discharge roller (fixation discharge member) 33. Against the fixation discharge roller 33, a pressing roller 33*a* is pressed to form a nip portion therebetween and is rotated by the rotation of the fixation discharge roller 33.

A front sheet-detection member S2 is disposed before a sheet entrance portion of the fixation nip portion N (at an intermediary portion of the front guide plate 31) (hereinafter, such a member is referred to as a "front sensor"), and detects the presence or absence of the recording sheet P conveyed from the conveyance belt 19 to the fixation nip portion N.

A rear sheet-detection member S2 is disposed after a sheet outlet portion of the fixation discharge roller 33 at an intermediary portion between the fixation discharge roller 33 and the flapper 34 (hereinafter, such a member is referred to as a "rear sensor"), and detects the presence or absence of the recording sheet P conveyed through the fixation discharge roller 33.

The front and rear sensors S1 and S2 are indicated in FIG. 2 as those of a flag-type but may be optical or ultrasonic sensors of a non-contact type.

Figure 5:
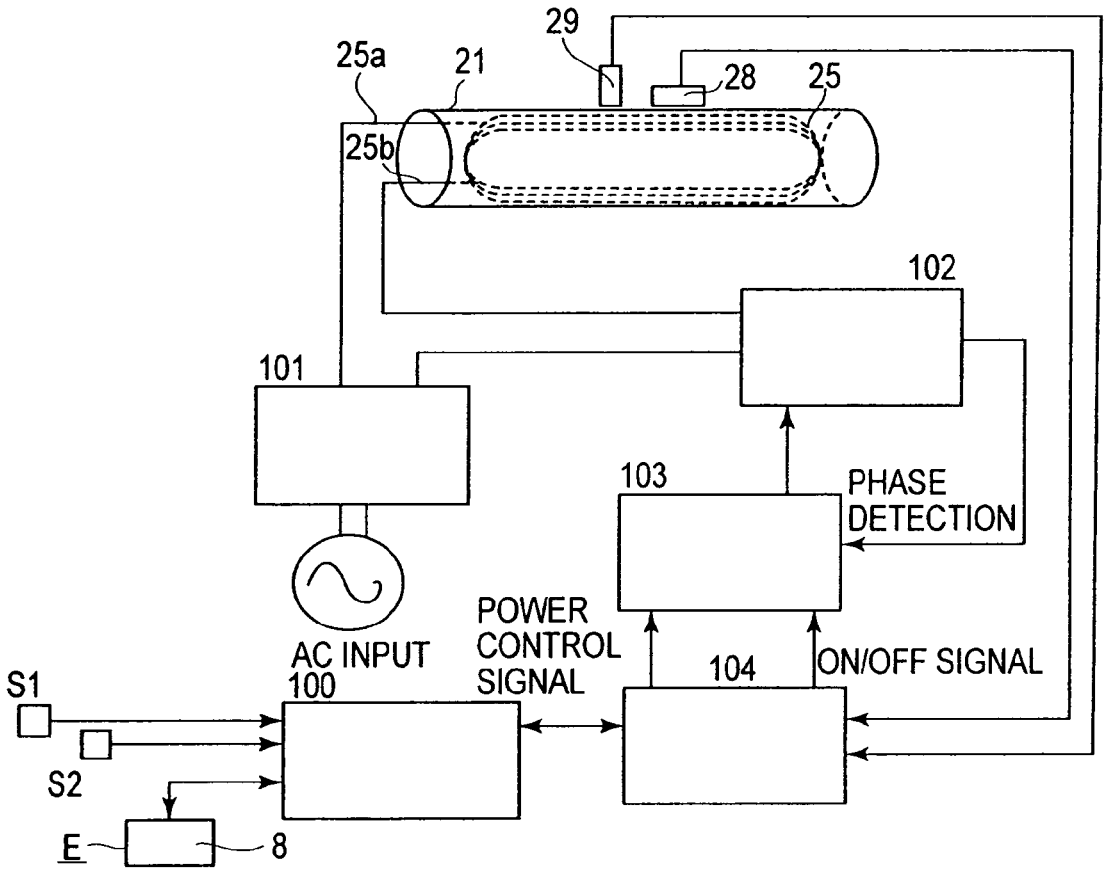
FIG. 5 is a block diagram showing a heating control system circuit (power supply circuit) of a fixing apparatus in Embodiment 1 or 2.

FIG. 5 is a block diagram of a heating control system circuit (power supply circuit) of the fixing apparatus 20 described above. This heating control system circuit includes a rectifier circuit 101 for rectifying AC input, a drive circuit for energizing the exciting coil 25, a resonance output control circuit 103 for supplying a drive signal to the drive circuit 102, and a power control circuit 104 for supplying a power control signal (electric power value) and an ON/OFF signal to the resonance output control circuit 103. The resonance frequency by detecting a phase of voltage waveform supplied from the drive circuit 102. Further, a detection temperature of the thermistor 28 is inputted into the power control circuit 104, which generates the ON/OFF signal and the power control signal so that the fixation roller 21 has a certain temperature (fixation temperature or target temperature) Further, a signal from the magnetic coil 29 is also inputted into the power control circuit 104, which outputs the ON/OFF signal and the power control signal to the resonance output control circuit 103 on the basis of detection level.

The main controller 100 of the image forming apparatus starts rotational drive by actuating an unshown fixation roller drive motor through power-on of a main power switch of the apparatus. By the rotation of the fixation roller 21, the pressure roller 22 is also rotated. Further, the main controller 100 actuates the above described heating control system circuit to pass a high-frequency current (e.g., 10 kHz to 500 kHz) through the exciting coil 25. As a result, high-frequency alternating magnetic flux is generated around the exciting coil 25, whereby the fixation roller 21 is heated, through electromagnetic induction, toward a predetermined fixation temperature. This temperature rise of the fixation roller 21 is detected by the thermistor 28, and detected temperature information is inputted into the power control circuit 104.

The power control circuit 104 controls the power supplied from the heating control system circuit to the exciting coil 25 so that the detected temperature, of the fixation roller 21, which is inputted from the thermistor 28, is kept at the predetermined fixation temperature, thus performing temperature rise of the fixation roller 21 and temperature control (heat regulation) at the fixation temperature. Then, in the temperature-controlled state, the recording sheet P, as a material to be heated, carrying thereon an unfixed toner image is introduced from the image formation side into the fixing nip portion N. The recording sheet P is sandwiched and conveyed between the fixation roller 21 and the pressure roller 22 in the nip portion N, whereby the unfixed toner image t is heat-fixed on the surface of the recording sheet P under heat by the fixation roller 1 and pressing force at the nip portion N.

(3) Winding Jam Detection

A plurality of sheet detection sensors including the front and rear sensors S1 and S2 for detecting the presence or absence of the conveyance recording sheet at important points along the sheet conveyance passages from the respective sheet feeding portion F1–F6 to the output tray portion G and the sheet re-feeding conveyance passage 37. The sheet (paper) detection signals from the respective sheet detection sensors are inputted into the main controller 100, which effects sequence control of the apparatus main assembly, such as latent image writing timing control with respect to the photosensitive drum 11, subsequent sheet feeding timing control, fixing sequence control, jam detection control, etc., on the basis of the sheet detection signals successively inputted from the respective sheet detection sensors.

With respect to jam detection, the main controller 100 judges that paper jam is caused to occur due to paper (sheet) conveyance failure at a sheet conveyance passage portion located upstream from an associated sheet detection sensor in the sheet conveyance direction when sheet detecting cannot be performed at predetermined timing by any one of the sheet detection sensors after start of sheet feeding operation, i.e., when a sheet detection signal from any one of sheet detection sensors after start of sheet feeding operation is not inputted even after lapse of proper sheet detection timing calculated on the basis of sheet feeding timing, sheet conveyance speed, sheet conveyance distance, etc., with respect to an associated sheet detection sensor. Then, the main controller 100 stops the drive of the image forming apparatus main assembly so that the image forming apparatus is placed in an emergency stop state and effects display of an occurrence of paper jam and points of occurrence thereof on the display portion 8 of the console portion E, thus providing notification to the user so as to remove the jammed paper.

The user opens an open/close cover of the apparatus main assembly and recognize the jammed paper, and then removes it from the apparatus main assembly. In this case, a safety switch (emergency stop switch) is turned off in synchronization with the opening of the open/close cover to place the power supply circuit of the apparatus main assembly in an open circuit state, thus ensuring electrical safety of the user who effects jam handling. After the jam handling, the open/close cover is closed and in synchronization therewith, the safety switch is turned on to place the power supply circuit in a close circuit state. The main controller 100 confirms that there is no residual paper in any sheet conveyance passages on the basis of the states of all the sheet detection sensors, thus resetting the jam state. As a result, the image forming apparatus main assembly is placed in such a state that image forming operation can be restarted.

Figure 6:
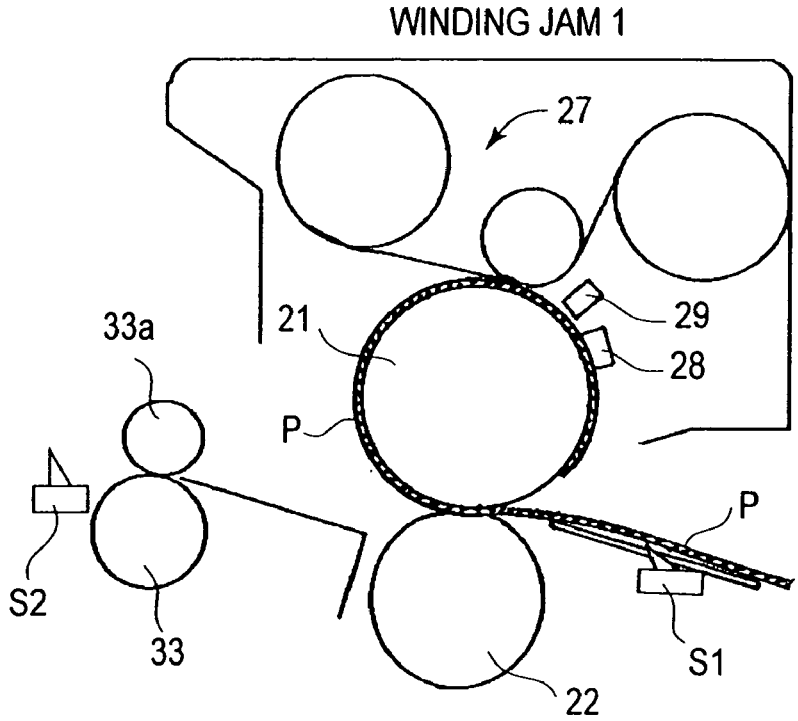
FIG. 6 is an explanatory view of winding jam 1 of a recording sheet with respect to the fixation roller in Embodiment 1 or 2.
Figure 7:
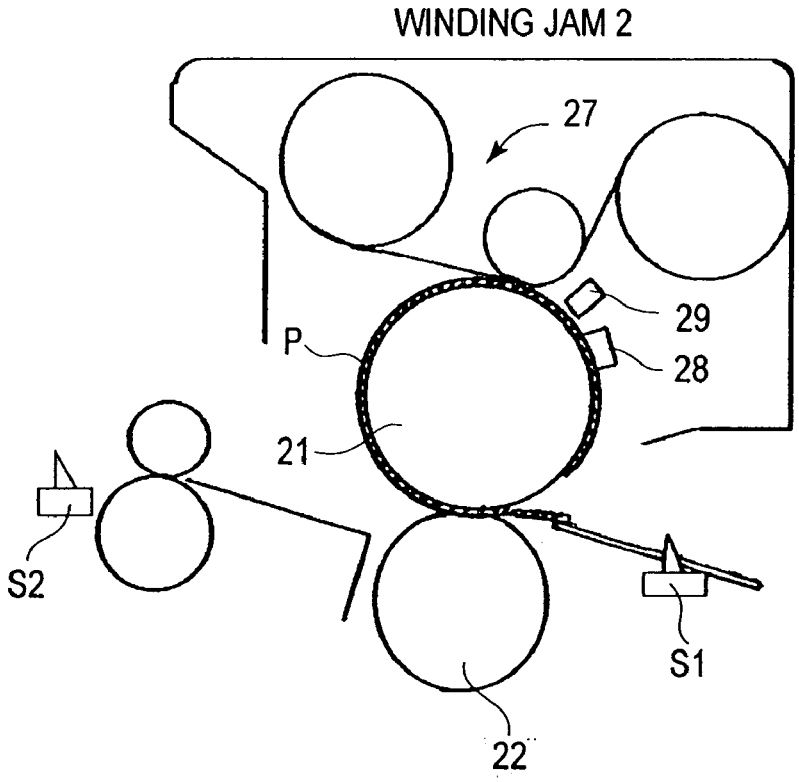
FIG. 7 is an explanatory view of winding jam 2 of a recording sheet with respect to the fixation roller in Embodiment 1 or 2.

As a type of paper jam peculiar to the fixing apparatus 20, there are winding jams 1 and 2 with respect to the fixation roller 21 as shown in FIGS. 6 and 7.

In both in the paper jams 1 and 2 shown in FIGS. 6 and 7, leading edge reaching detection of the recording sheet P is performed by the front sensor S1 within the proper sheet detection timing but the recording sheet P is wound around the fixation roller 21, whereby the leading edge reaching detection of the recording sheet P by the rear sensor S2 is not performed within the proper sheet detection timing. As a result, emergency stop control of the drive of image forming apparatus main assembly by the main controller 100 is performed to place the image forming apparatus in such a state that the rotational drive of the fixation roller 21 and the power supply to the exciting coil 25 are stopped.

In the case of the winding jam 1 shown in FIG. 6, the recording sheet P has a long length, so that a trailing edge thereof has not been passed through completely the front sensor S1. As a result, the drive of the apparatus is stopped in such a state that the front sensor S1 detects the recording sheet P.

In the case of the winding jam 2 shown in FIG. 7, the recording sheet P has a short length, so that a trailing edge thereof has completely been passed through the front sensor S1. As a result, the drive of the apparatus is stopped in such a state that the front sensor S1 does not detect the recording sheet P (complete winding jam).

In the case of the winding jam 1 shown in FIG. 6, even when the open/close cover is closed while the jammed paper is not removed, the front sensor S1 detects the presence of the recording sheet P, so that the main controller 100 does not perform reset of the jam state and again effects display of a message, on the display portion f of the console portion E, to the effect that the user should remove the jammed paper.

However, in the case where the winding jam 2 (complete winding jam) shown in FIG. 1 occurs or where, in the case of the winding jam 1 shown in FIG. 6, a trailing edge portion of the recording sheet P is broken when the trailing edge of the recording sheet P is pulled so as to remove the recording sheet P during jam handling but the leading edge portion is left while being wound around the fixation roller 21, the front sensor S1 does not detect the presence of the recording sheet P when the open/close cover is closed without completely removing the remaining leading edge portion of the recording sheet P. As a result, the main controller 100 performs reset of the jam state. In other words, the user turns power an again and continues the state without recognising the winding of the recording roller P around the fixation roller 21, so that an image output state is poor in flexibility.

When the winding occurs during the sheet conveyance, the recording sheet P does not reach the rear sensor S2, thus leading to delayed jam for the rear sensor S2. The history of such a jam occurrence is stored and held in the main controller 100.

Further, when the jam once occurs, in such a state that the paper (recording sheet) P is wound around the fixation roller 21, a frictional force of the fixation roller 21 is generally changed. As a result, even when the recording sheet P is passed through the fixation roller 21 again, doubles winding is caused to occur, thus resulting in the same jam.

In this embodiment, it is also possible to detect the winding of the recording sheet P around the fixation roller 21 as described above. The winding jam as shown in FIG. 7 is detected on the basis of temperature detection signal information by the thermistor 28 of the fixation roller 21 (induction heating element) and Curie temperature reaching detection signal information by the magnetic coil 29 of the fixation roller 21. Hereinbelow, this detection will be described more specifically.

The magnetic coil 29 as the Curie temperature reaching detection means induces leakage magnetic flux when the temperature of the fixation roller 21 which is the induction heating element reaches a Curie temperature Tc by electromagnetic induction heating.

Figure 8:
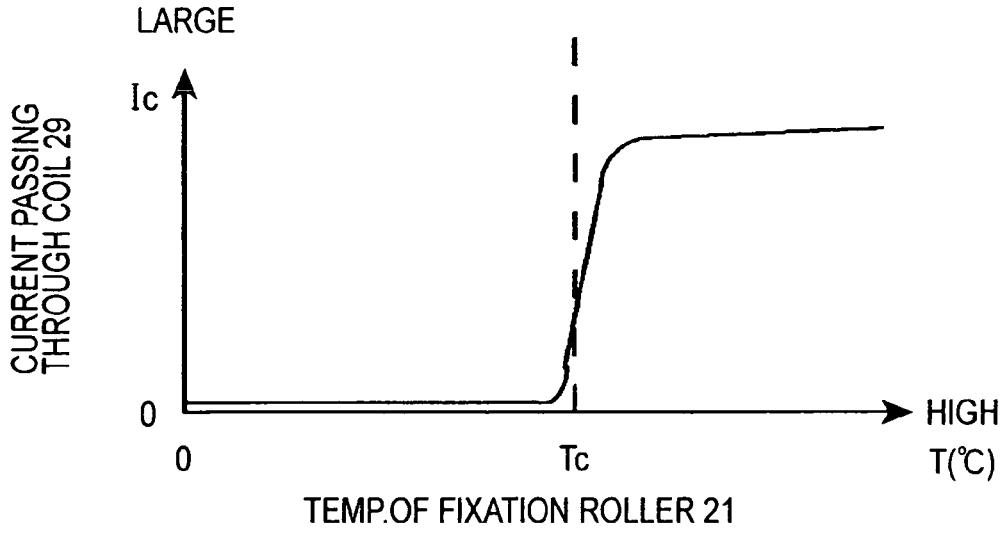
FIG. 8 is an output characteristic chart of a magnetic coil in Embodiment 1 or 2.

Here, the Curie temperature Tc means a temperature at which a magnetic material such as a ferromagnetic material is changed to a paramagnetic material. A permeability of the ferromagnetic material is gradually lowered under heating but is abruptly lowered when the temperature of the fixation roller 21 reaches the Curie temperature Tc. For this reason, magnetic flux which is generated from the exciting coil 25 (magnetic flux generation means) and acts on the fixation roller 21 (induction heating element) passes through the fixation roller 21 when the fixation roller temperature reaches the Curie temperature Tc by electromagnetic induction heating to leak out of the fixation roller. By the resultant leakage magnetic flux, an induction current passes through the magnetic coil 29. It becomes possible to detect that the fixation roller temperature reaches the Curie temperature Tc by detecting start of passage of current through the magnetic coil 29. FIG. 8 is a graph showing a relationship between a temperature of the fixation roller 21 (abscissa) and a value Ic of current passing through the magnetic coil 29 (ordinate). Referring to FIG. 8, below the Curie temperature Tc, there is substantially no magnetic flux, so that the current Ic passing through the magnetic coil 29 is substantially zero but when the fixation roller temperature reaches the Curie temperature Tc, the amount of the current Ic passing through the magnetic coil 29 is rapidly increased due to the rapid increase in leakage magnetic flux.

As described above, it is possible to detect that the fixation roller temperature reaches the Curie temperature Tc by the induction current of the magnetic coil 29 but a predetermined target temperature (fixation temperature) Ta is generally kept at a temperature lower than the Curie temperature Tc.

The fixation roller 21 is, as described above, subjected to start-up of temperature rise and temperature control at the target temperature Ta by inputting the detection temperature information of the fixation roller 21 through the thermistor 28 into the power control circuit 104 and controlling the power supplied from the heating control system circuit (FIG. 5) to the exciting coil 25 by the power control circuit 104 so that the fixation roller detection temperature inputted from the temperature 28 is kept at the predetermined target temperature Ta.

Figure 9:
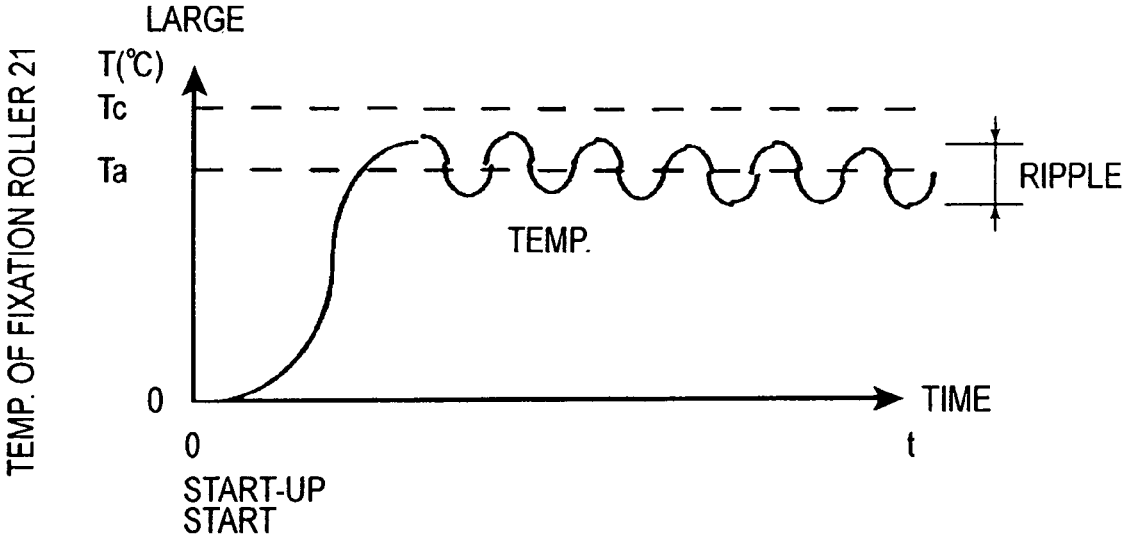
FIG. 9 is a graph showing a change in temperature with time of the fixation roller in Embodiment 1 or 2.

The temperature control of the fixation roller 21 is performed so that the detection temperature of the thermistor 28 becomes constant as the predetermined target temperature, and the target temperature is lower than the Curie temperature Tc of the fixation roller 21. As a result, in this thermistor control state, leakage magnetic flux toward the output of the fixation roller 21 is not substantially caused to occur. Accordingly, in an ordinary state, current does not pass through the magnetic coil 29. FIG. 9 shows a detection temperature by the thermistor 28 at the time of start-up of the image forming apparatus, wherein an abscissa represents a time and an ordinate represents a temperature (detection temperature by the thermistor 28) of the fixation roller 21. As shown in FIG. 9, the resultant temperature curve becomes such a signal that it alternately goes up and down the target temperature as a center line depending on a responsiveness of the thermistor 28.

Figure 10:
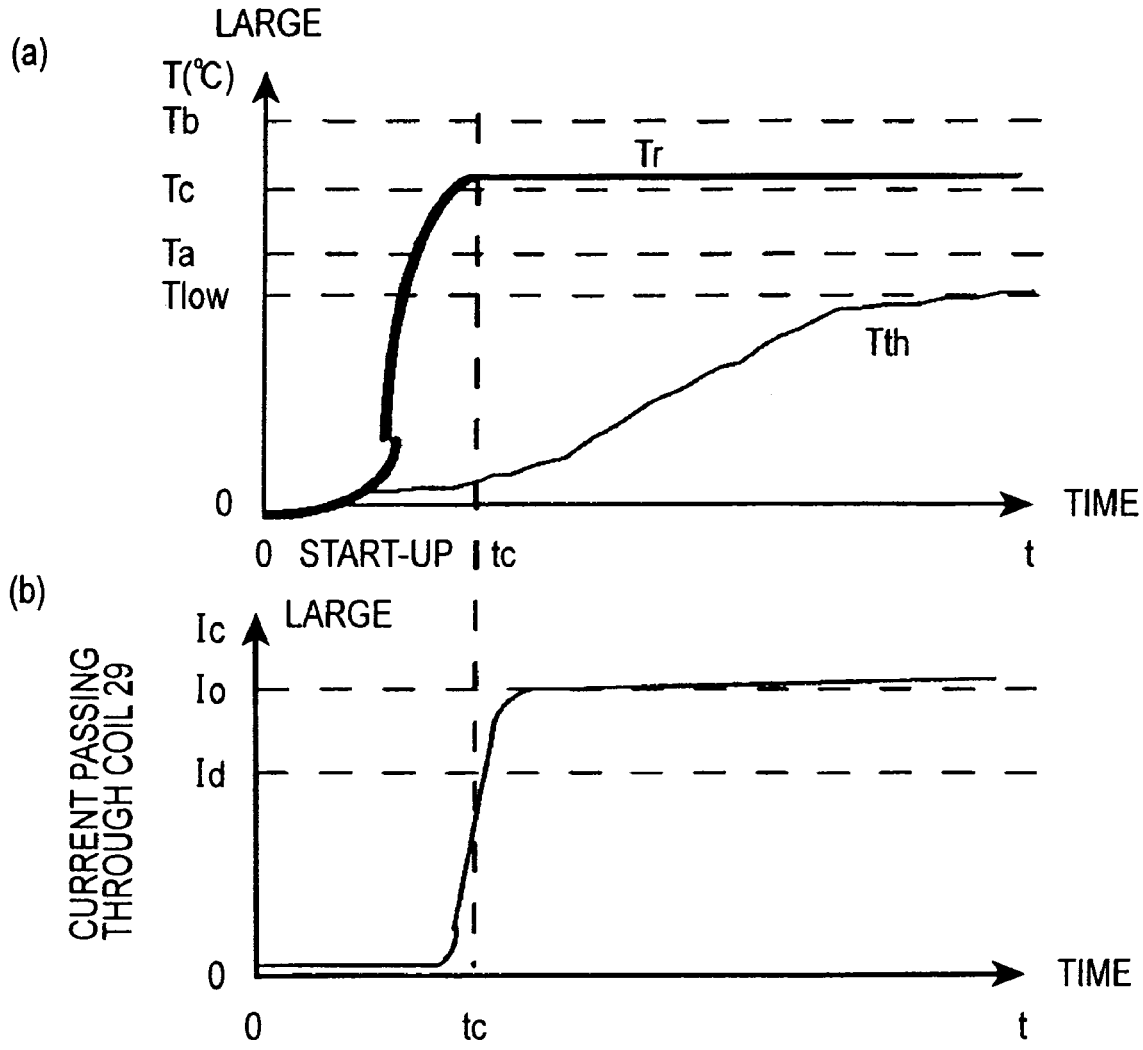
FIGS. 10(*a*) and 10(*b*) are graphs showing a temperature characteristic of the fixation roller and an output characteristic of the magnetic coil when a recording sheet is wound around the fixation roller in Embodiment 1 or 2.

In the case where the recording sheet P is wound around the fixation roller 21, the recording sheet P is placed in such a state that it adheres to the fixation roller 21 surface, so that the recording sheet P is in such a state that it enters between the fixation roller 21 and the thermistor 28 or between the fixation roller 21 and the exciting coil 29. In this state, when the image forming apparatus is started up, the fixation roller temperature detection signal of the thermistor 28 is indicated by a curve Tth as shown in FIG. 10(*a*), thus resulting in slow start-up. This is because heat of the fixation roller 21 is blocked by the wound recording sheet P, so that the detection temperature of the thermistor 28 is detected as a temperature lower than an actual temperature of the fixation roller 21. Accordingly, the actual temperature of the fixation roller 21 is indicated by a curve Tr as shown in FIG. 10(*a*), so that the actual temperature Tr of the fixation roller 21 reaches up to the Curie temperature Tc before the thermistor 28 detects the predetermined target temperature (fixation temperature) Ta. As a result, leakage magnetic flux is generated outside the fixation roller 21. The magnetic coil 29 can detect magnetism even in the presence of the non-magnetic recording sheet P between the magnetic coil 29 and the fixation roller 21, so that an induction current Ia passes through the magnetic coil 29 as shown in FIG. 10(*b*).

As described above, in the case where the recording sheet P is completely wound around the fixation roller 21, after the start-up of the image forming apparatus, the leakage magnetic flux is detected by the magnetic coil before the thermistor 28 detects the predetermined target temperature (fixation temperature) Ta. With respect to the fixing apparatus 20, the drive of the fixation roller 21 is stopped and the electromagnetic induction heating of the fixation roller 21 is also stopped by blocking the power supply from the power supply circuit by the power control circuit 104 to stop the power supply to the exciting coil 25. The main controller 100 effects display of a massage, on the display portion 108 of the display console portion E, to the effect that it notifies the user of winding of the recording sheet P around the fixation roller 21.

The user opens the open/close cover of the apparatus main assembly and finds and removes the recording sheet P wound around the fixation roller 21. In the case of the winding jam around the fixation roller 21, the fixation portion is still in a high-temperature state, so that the user cannot readily effect jam handling. Further, when the user removes the jammed paper by force, there is a possibility that the fixation roller 21 is damaged. As a result, it is also necessary to effect the jam handling by a service person in some cases.

Figure 11:
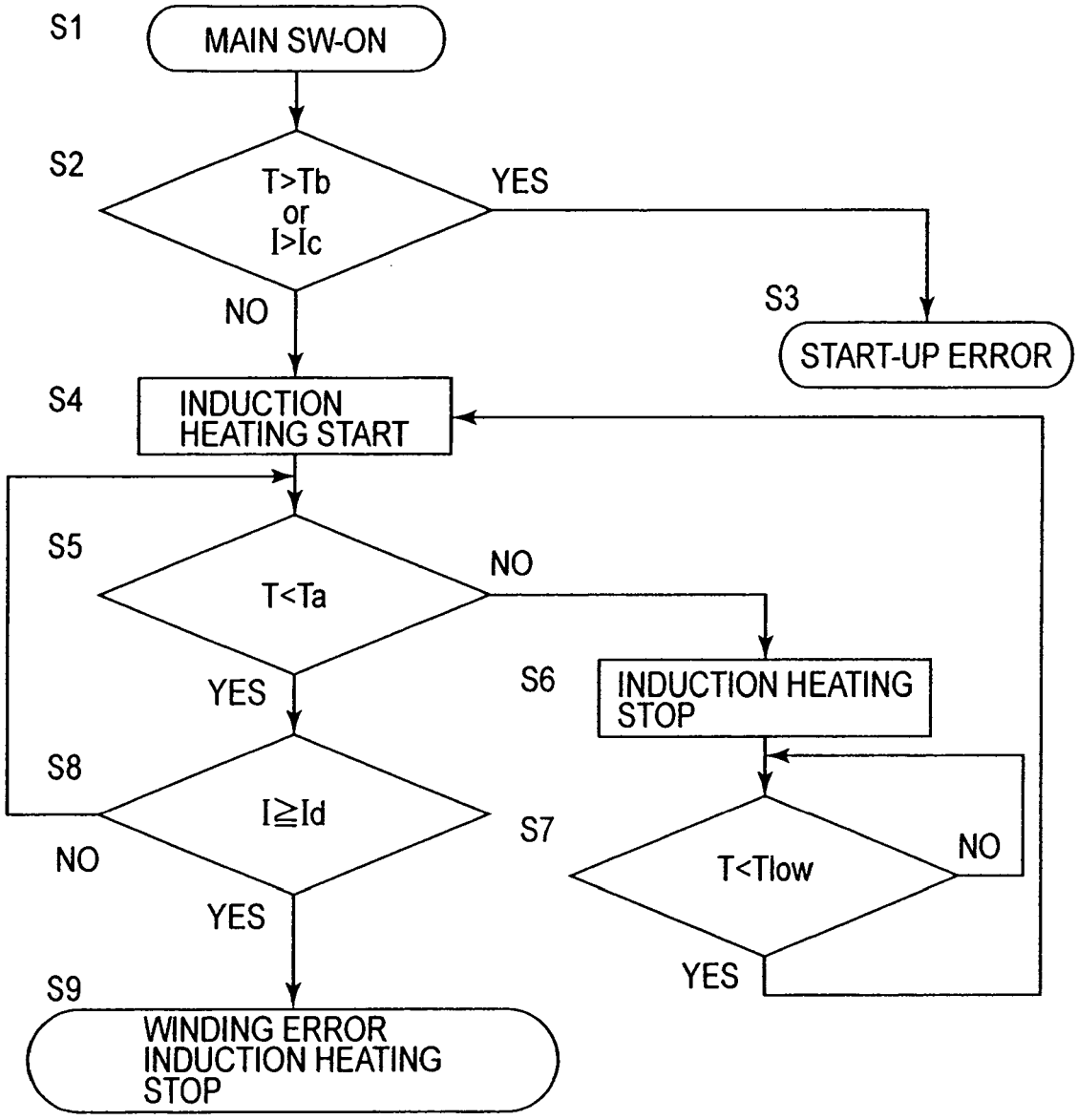
FIG. 11 is a flow chart showing a temperature control sequence including detection of winding jam of recording sheet with respect to the fixation roller in Embodiment 1.

FIG. 11 is an temperature control sequence diagram of the fixation roller 20 including detection of the winding jam of the recording sheet P around the fixation roller 21.

When the main power switch of the image forming apparatus is turned on or the image forming apparatus is placed in such a state that image forming operation of the image forming apparatus main assembly can be restarted by closing the open/close cover to turn the safety switch on after the jam handling, thereby to place the power supply circuit in the closed circuit state and confirming that there is no residual recording sheet in any sheet conveyance passages by the main controller 100 on the basis of the states of all the sheet detection sensors to reset the jammed state (Step S1), first of all, signals from the thermistor 28 and the magnetic coil 29 are checked to confirm that a detection temperature T of the thermistor 28 is not more than an error temperature Tb (e.g., 230° C.) or a current value I of the magnetic coil 29 is not more than a current value Ic at which the fixation roller temperature reaches the Curie temperature ("NO" of Step S2). In this case, when the detection temperature of the thermistor 28 exceeds Tb or the current Ic passes through the magnetic coil 29, or the control circuit is broken to cause short-circuit, so that heating of the fixation roller 21 is stopped and an error massage is provided (Step S3).

When normal values are detected, the rotational drive of the fixation roller 21 is started and power is supplied to the exciting coil 25 to start induction heating of the fixation roller 21 (Step S4).

During the heating of the fixation roller 21, the detection temperature T of the thermistor 28 is monitored (Step S5). When the detection temperature T reaches a target temperature (Fixation temperature) Ta (e.g., 200° C.), the induction heating is stopped (Step S6). After the sop of induction heating, when the detection temperature T of the thermistor 28 is lower than a predetermined temperature Tlow (e.g., 190° C.) which is lower than the target temperature Ta (Step S7), the induction heating is restarted (Step S4). In an ordinary operation, the temperature of the fixation roller 21 is temperature-controlled to be kept at the target temperature (fixation temperature) Ta by repeating Steps S4 to S7 described above.

On the other hand, although the detection temperature T of the thermistor 28 is lower than the target temperature Ta ("YES" of Step S5), when the coil current Ic of the magnetic coil 29 is not less than a threshold current Id at which the fixation roller temperature reaches a Curie temperature (e.g., 220° C.) ("YES" of Step S8), the main controller 100 judges that the recording sheet P is present in such a complete winding state that it is wound around the fixation roller 21 as shown in FIG. 7 (winding error) and then immediately stops the drive of the image forming apparatus. With respect to the fixing apparatus 20, the drive of the fixation roller 21 is stopped and the power supply to the exciting coil 25 is stopped by blocking the power supply to the fixation roller 21 by the power control circuit 104, thus stopping the electromagnetic induction heating of the fixation roller 21. The main controller 100 provides the user with such a notification that the recording sheet P is wound around the fixation roller 21 by displaying a massage to that effect on the display portion 8 of the console portion E (Step S9).

In this embodiment, however, it is also possible to display of such a massage, on the display portion 8, to the effect that the user should remove the recording sheet P wound around the fixation roller 21 or there is a high probability of winding of the recording sheet P.

In Step S8, the threshold Id may preferably be set to be lower than a current value Io at which the fixation roller temperature reaches the CUrie temperature Tc.

Figure 16:
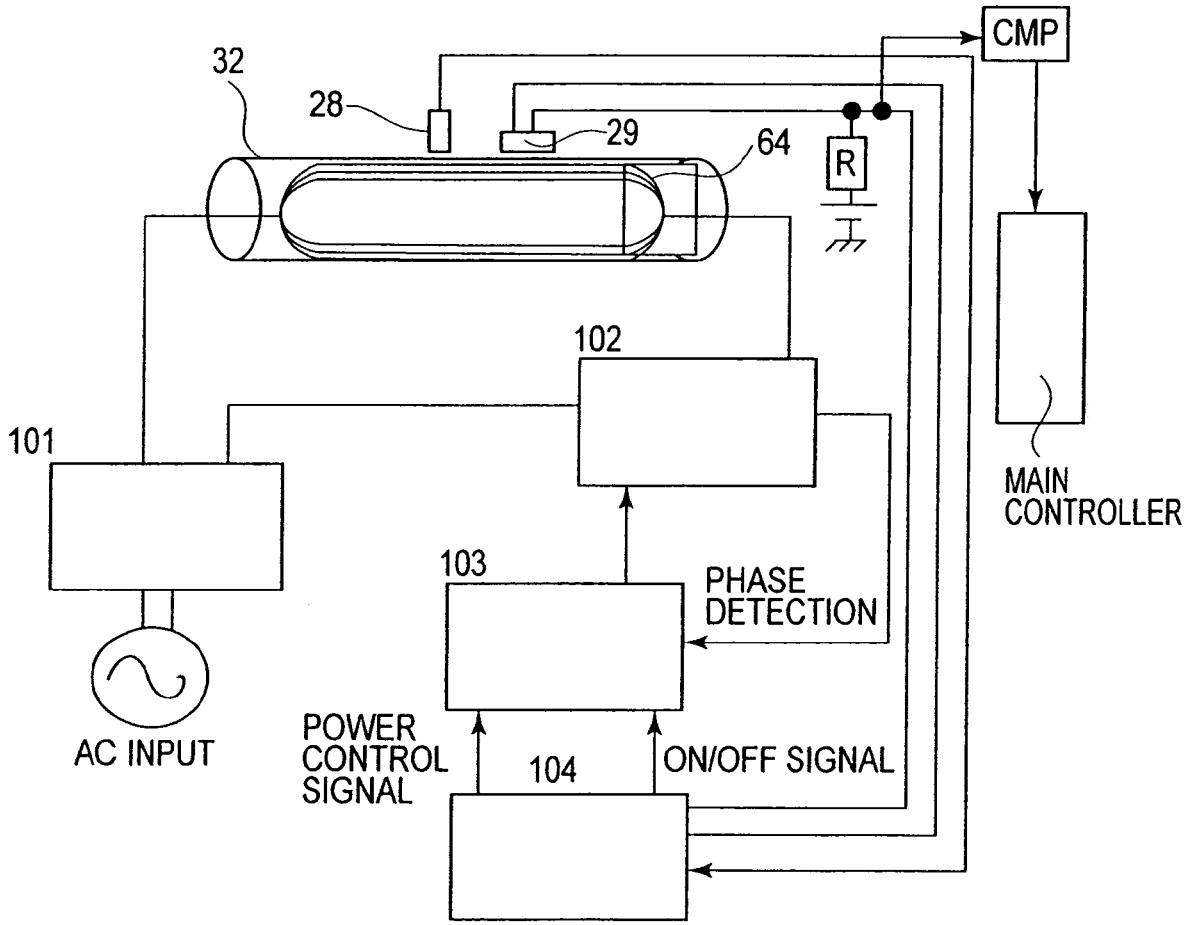
FIG. 16 is a block diagram showing a heating control system circuit (power supply circuit) of the fixing apparatus in Embodiment 1.

Further, in Step S3, it is also possible to check whether the coil is broken or not. In these case, a power source is connected to the magnetic coil 29 through a resistance as shown in FIG. 16, whereby a voltage is divided by the resistance and the coil. As a result, the voltage is detected by a comparator (CMP) whether it is not more than a threshold value. Output from the CMP is inputted into the main controller. The main controller judges whether the coil is broken or not on the basis of the output from the CMP. In the case of the break in the coil, the main controller sends an error signal so as to immediately stop the apparatus.

As described above, by judging that the temperature detection means and the Curie temperature reaching detection means are not abnormal, in the case where detection results of the temperature detection means and the Curie temperature reaching detection means are abnormal, it is possible to determine the abnormality as that due to the winding of the recording sheet around the fixation roller.

Embodiment 2

In this embodiment, the winding jam detection in Embodiment 1 is further improved. Explanation of the same constituent as in Embodiment 1 will be omitted.

In this embodiment error detection of the winding jam can be performed more accurately. Hereinbelow, such an error detection will be described in detail.

In this embodiment, when the recording sheet P is completely wound around the fixation roller 21 as shown in FIG. 7, leakage magnetic flux is obtained by the magnetic coil 29 before the apparatus is stated up and the temperature 28 detects a predetermined target temperature (fixation temperature) Ta, whereby the main controller can judge an occurrence of abnormality such that there is a possibility that the recording sheet P is wound around the fixation roller 21. In this case, when a previous jam history is referred to and when delay jam of the sensor S2 as the reaching detection means further material to be heated is caused to occur, the main controller judges that the recording sheet P is wound around the fixation roller 21 to immediately stop the drive of the image forming apparatus. With respect to the fixing apparatus 20, the drive of the fixation roller 21 is stopped and the electromagnetic induction heating of the fixation roller 21 is stopped by interrupting the power supply circuit by the power control circuit 104 to stop the power supply to the exciting coil 25. Further, the main controller 100 display a massage, on the display portion 8 of the console portion E, of notifying the user of the winding of the recording sheet P around the fixation roller 21. In other words, in the case of immediately after the reaching detection means for the material to be heated detects the occurrence of jam (immediately after there is a possibility that the recording sheet P is wound around the fixation roller 21), judgement that the recording sheet P is wound around the fixation roller 21 on the basis of detection results of the temperature detection means and the Curie temperature reaching detection means is made, whereby it becomes possible to determine whether or not the abnormality is attributable to the winding of the recording sheet P or other reasons.

The user opens the open/close cover of the apparatus main assembly and finds and removes the recording sheet P wound around the fixation roller 21. In the case of the winding jam around the fixation roller 21, the fixation portion is still in a high-temperature state, so that the user cannot readily effect jam handling. Further, when the user removes the jammed paper by force, there is a possibility that the fixation roller 21 is damaged. As a result, it is also necessary to effect the jam handling by a service person in some cases.

Figure 15:
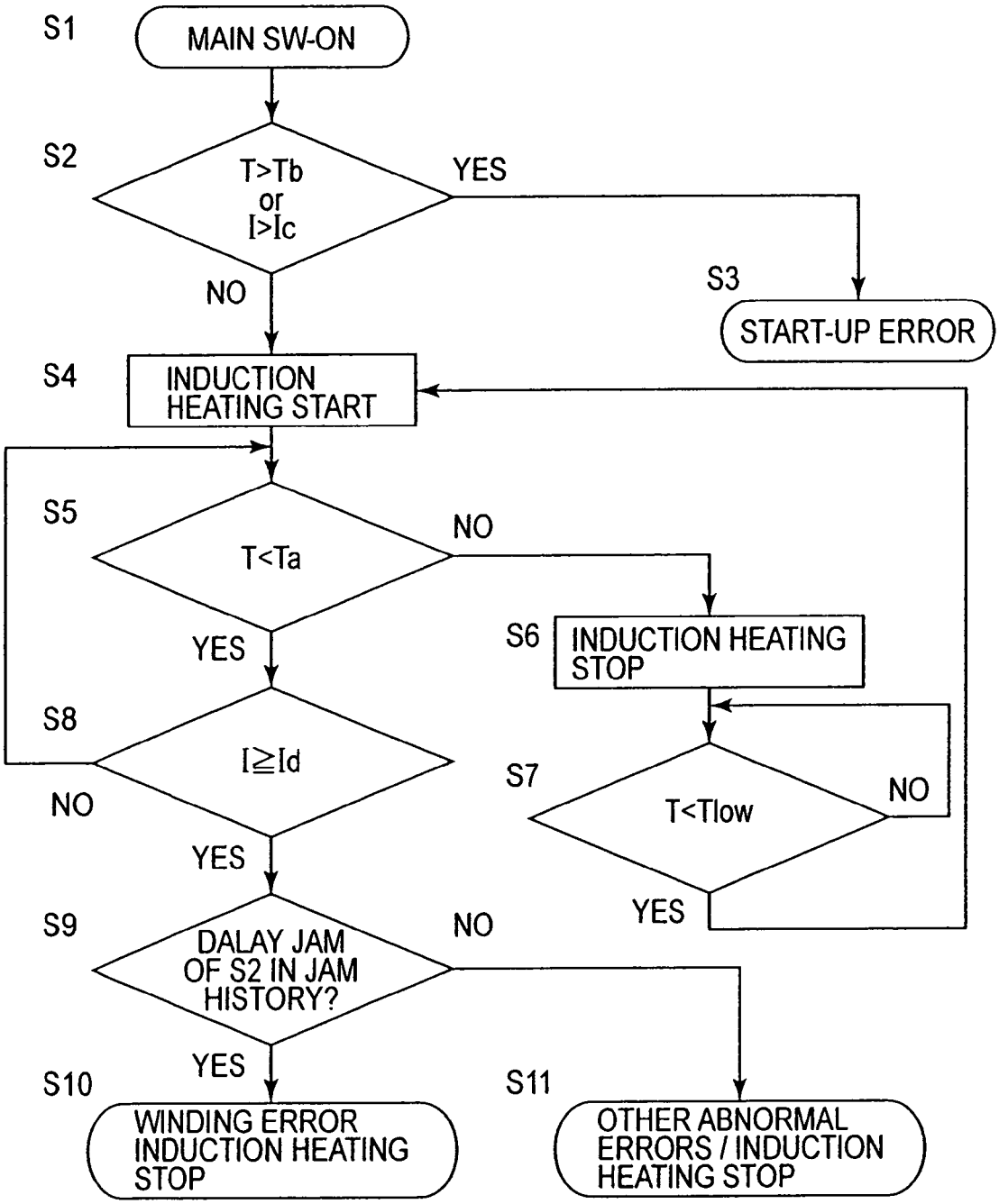
FIG. 15 is a flow chart showing a temperature control sequence including detection of winding jam of recording sheet with respect to the fixation roller in Embodiment 2.

FIG. 15 is an temperature control sequence diagram of the fixation roller 20 including detection of the winding jam of the recording sheet P around the fixation roller 21 in this embodiment.

When the main power switch of the image forming apparatus is turned on or the image forming apparatus is placed in such a state that image forming operation of the image forming apparatus main assembly can be restarted by closing the open/close cover to turn the safety switch on after the jam handling, thereby to place the power supply circuit in the closed circuit state and confirming that there is no residual recording sheet in any sheet conveyance passages by the main controller 100 on the basis of the states of all the sheet detection sensors to reset the jammed state (Step S1), first of all, signals from the thermistor 28 and the magnetic coil 29 are checked to confirm that a detection temperature T of the thermistor 28 is not more than an error temperature Tb (e.g., 230° C.) or a current value I of the magnetic coil 29 is not more than a current value Ic at which the fixation roller temperature reaches the Curie temperature ("NO" of Step S2). In this case, when the detection temperature of the thermistor 28 exceeds Tb or the current Ic passes through the magnetic coil 29, or the control circuit is broken to cause short-circuit, so that heating of the fixation roller 21 is stopped and an error massage is provided (Step S3). Further, in Step S3, it is also possible to effect check as to whether the coil is broken or not.

When normal values are detected, the rotational drive of the fixation roller 21 is started and power is supplied to the exciting coil 25 to start induction heating of the fixation roller 21 (Step S4).

During the heating of the fixation roller 21, the detection temperature T of the thermistor 28 is monitored (Step S5). When the detection temperature T reaches a target temperature (Fixation temperature) Ta (e.g., 200° C.), the induction heating is stopped (Step S6). After the sop of induction heating, when the detection temperature T of the thermistor 28 is lower than a predetermined temperature Tlow (e.g., 190° C.) which is lower than the target temperature Ta (Step S7), the induction heating is restarted (Step S4). In an ordinary operation, the temperature of the fixation roller 21 is temperature-controlled to be kept at the target temperature (fixation temperature) Ta by repeating Steps S4 to S7 described above.

On the other hand, although the detection temperature T of the thermistor 28 is lower than the target temperature Ta ("YES" of Step S5), when the coil current Ic of the magnetic coil 29 is not less than a threshold current Id at which the fixation roller temperature reaches a Curie temperature (e.g., 220° C.) ("YES" of Step S8), a jam history is referred to. In the case where an immediately before history is the delay jam of the sensor S2 ("YES" of Step S9), the main controller 100 judges that the recording sheet P is wound around the fixation roller 21 and stops the drive of the image forming apparatus immediately. On the other hand, in the case where the immediately before history is not the delay jam of the sensor S2 ("NO" of Step S9), the main controller 100 judges that the winding of the recording sheet P is not caused to occur but another abnormality is caused to occur, and stops immediately the drive of the image forming apparatus. The main controller 100 further displays an error signal (message), on the display portion 8, indicating an occurrence of another abnormality at the fixation portion. Further, in the case where the immediately before history is the delay jam of the sensor S2, the main controller 100 judges that the recording sheet P is present in such a complete winding state that it is wound around the fixation roller 21 as shown in FIG. 7 (winding error) and then immediately stops the drive of the image forming apparatus. With respect to the fixing apparatus 20, the drive of the fixation roller 21 is stopped and the power supply to the exciting coil 25 is stopped by blocking the power supply to the fixation roller 21 by the power control circuit 104, thus stopping the electromagnetic induction heating of the fixation roller 21. The main controller 100 provides the user with such a notification that the recording sheet P is wound around the fixation roller 21 by displaying a massage to that effect on the display portion 8 of the console portion E (Step S10).

In this embodiment, the immediately before history means such a history as to whether the jam is caused to occur during the immediately preceding heating operation. Further, one heating operation means such an operation from start of copying operation (heating operation) of the heating apparatus through input of copy signal to completion of the heating operation by heating the material to be heated at the nip portion of the fixation roller and performing a sequence of copy job.

In Step S8, the threshold Id may preferably be set to be lower than a current value Io at which the fixation roller temperature reaches the CUrie temperature Tc.

In this embodiment, detection as to whether the paper winding is caused or not only by using the sensor S2 located downstream from the fixation roller. However, in a preferred embodiment, in the case where the two sensors S1 and S2 are disposed upstream and downstream, respectively, from the fixation roller as reaching detection means for the material to be heated and the upstream sensor S7 detects the reaching of the material to be heated but the sensor S2 does not detect the reaching of the material to be heated, when detection results of the temperature detection means and the Curie temperature reaching detection means are abnormal (when such a detection that the temperature detected by the temperature detection means is lower than the Curie temperature and the temperature of the heating element (fixation roller) detected by the Curie temperature reaching detection means reaches the Curie temperature is made) during first heating operation after the above described detection, judgement that the recording sheet P is wound around the fixation roller is made. By doing so, it is possible to further improve detection accuracy of the winding abnormality.

Further, in order to judge as to whether the recording sheet is wound around the fixation roller is simple paper jam is caused to occur in the case where the upstream sensor (reaching detecting means for the material to be heated) located immediately before the nip portion of the fixation roller detects the reaching of the material to be heated but the downstream sensor located immediately after the nip portion of the fixation roller does not detect the reaching of the material to be heated, it is also possible to employ such a paper winding judgement mode that the fixation roller is temperature-controlled at a predetermined temperature for a predetermined period (e.g., a fixation temperature control) and during the predetermined period, such a detection that the fixation roller temperature (heating element temperature) is lower than the Curie temperature by the temperature detection means but reaches the Curie temperature by the Curie temperature reaching detection means is made.

Embodiment 3

In this embodiment, a method of detecting the temperature, of the fixation roller 21, which reaches the Curie temperature, in a heating control system circuit of an electromagnetic induction heating apparatus of the image forming apparatus used in Embodiment 1 or Embodiment 2.

Figure 12:
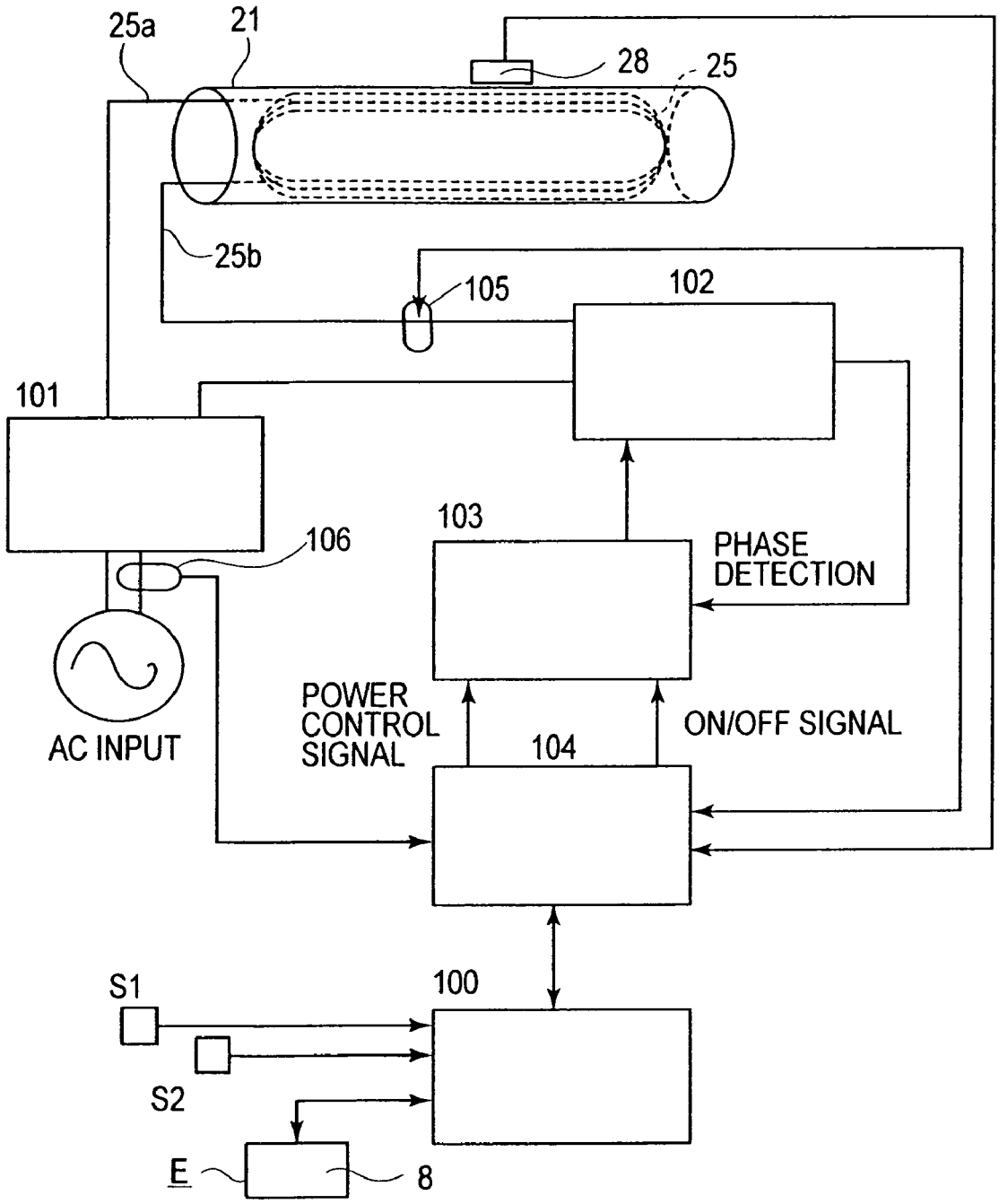
FIG. 12 is a block diagram of a heating control system circuit (power supply circuit) of a fixing apparatus in Embodiment 3.

FIG. 12 shows a block diagram of the heating control system circuit of the fixing apparatus (electromagnetic induction heating apparatus).

Figure 13:
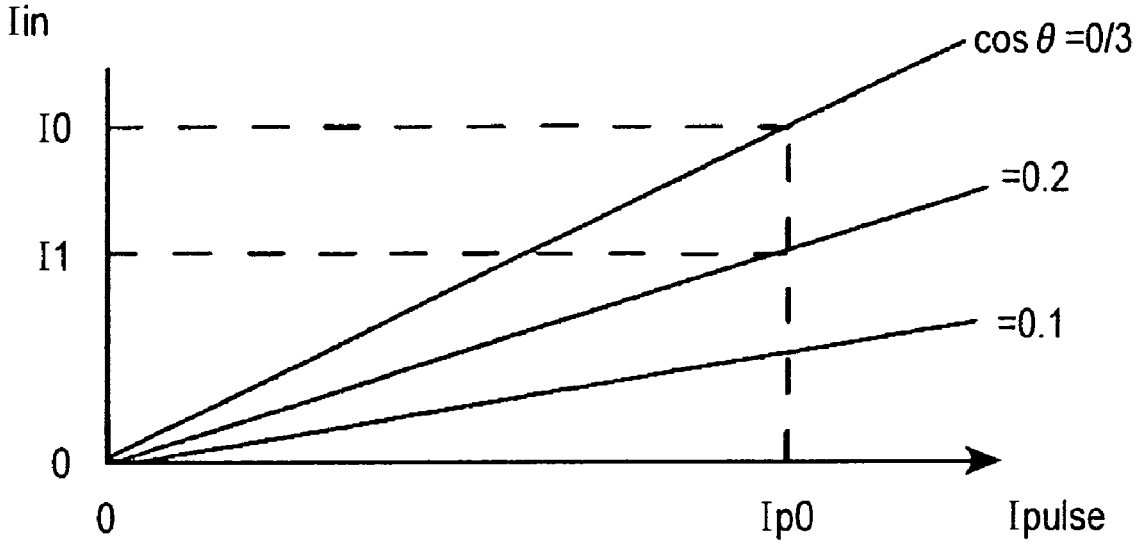
FIG. 13 is a graph showing a change in input current with respect to power factor of a fixation roller in Embodiment 3.

Outputs from a pulse current detection device 105 for detecting a current value of a pulse waveform outputted from a drive circuit and a pulse current detection device 106 for detecting a current value of an AC inputted into a fixation roller 21 are inputted into a power control circuit 104. The power control circuit 104 outputs a power control signal to a resonance output control circuit 103 so that the signal from the pulse current detection device 105 becomes constant. The fixation roller 1 (induction heating element) is heated by an exciting coil 25 but when the fixation roller temperature reaches a Curie temperature Tc, a power factor thereof is lowered due to a characteristic of a magnetic material. FIG. 13 shows a relationship between a pulse current I pulse and an AC input current Iin with respect to a change in power factor cos θ. In order to keep the temperature of the fixation roller 21 at a predetermined certain temperature, such a control that the pulse current Ipulse is kept constant is performed. When the fixation roller temperature reaches the Curie temperature Tc, the power factor is lowered, so that the AC input current Iin is lowered from I0 to I1. By the AC current detection device 106, the lowering in AC input current is detected, whereby the power control circuit 104 judges that the temperature of the fixation roller 21 reaches the Curie temperature Tc.

When the thermistor 28 detects that the fixation roller temperature reaches the Curie temperature Tc due to the lowering in AC input current before the fixation roller temperature does not reach a target temperature (fixation temperature) Ta in the case where some relationship between the temperature 28 and the AC input current is satisfied, judgement that the recording sheet P is wound around the fixation roller 21 (complete winding) is made.

Figure 14:
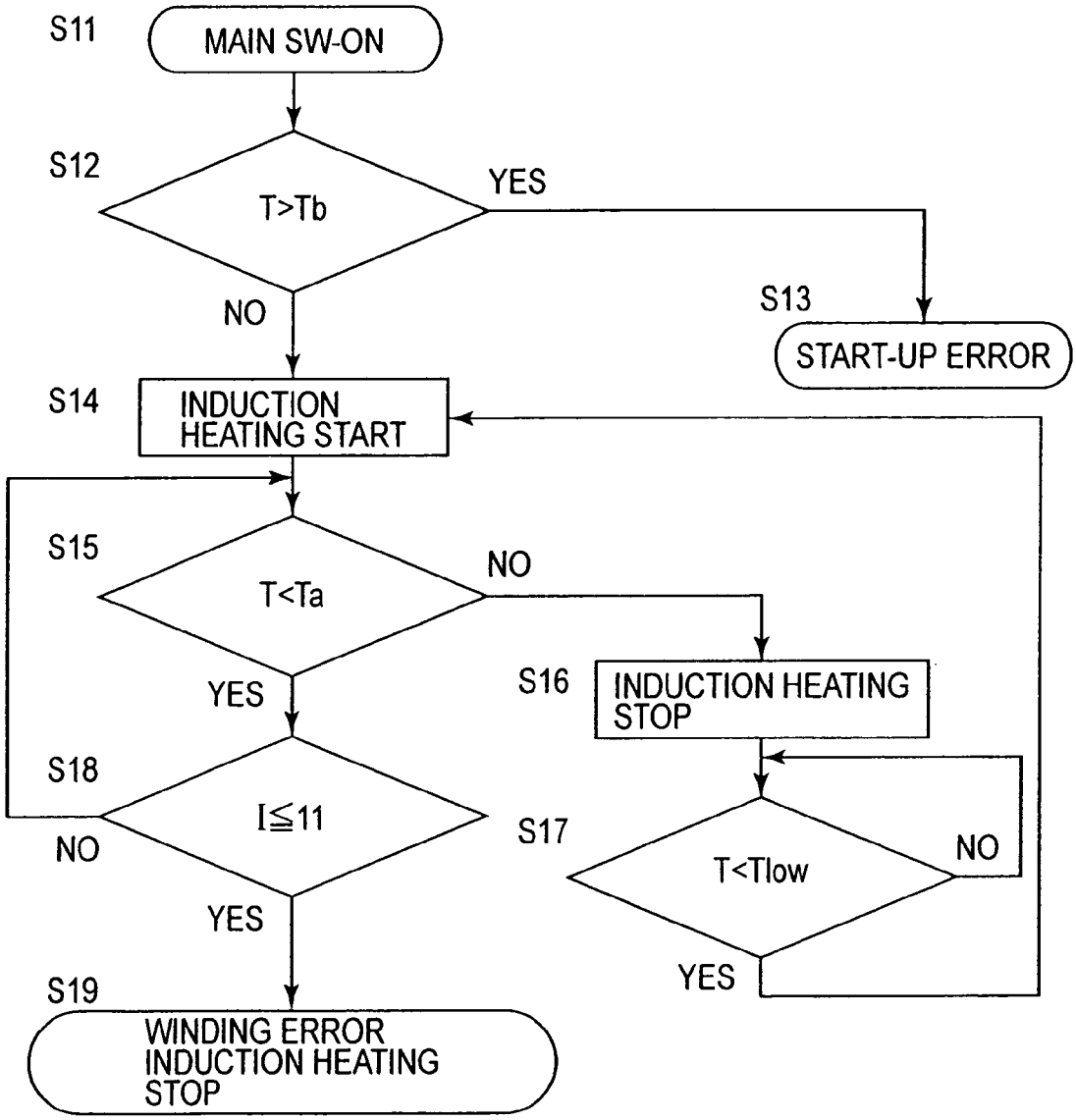
FIG. 14 is a flow chart showing a temperature control sequence including detection of winding jam of recording sheet with respect to the fixation roller in Embodiment 3.

FIG. 14 is an temperature control sequence diagram of the fixation roller 20 including detection of the winding jam of the recording sheet P around the fixation roller 21.

When the main power switch of the image forming apparatus is turned on or the image forming apparatus is placed in such a state that image forming operation of the image forming apparatus main assembly can be restarted by closing the open/close cover to turn the safety switch on after the jam handling, thereby to place the power supply circuit in the closed circuit state and confirming that there is no residual recording sheet in any sheet conveyance passages by the main controller 100 on the basis of the states of all the sheet detection sensors to reset the jammed state (Step S11), first of all, a signal from the thermistor 28 is checked to confirm that a detection temperature T of the thermistor 28 is not more than an error temperature Tb ("NO" of Step S12). In this case, when the detection temperature of the thermistor 28 exceeds Tb, there is a possibility that the thermistor 28 or the control circuit is broken to cause short-circuit, so that heating of the fixation roller 21 is stopped and an error massage is provided (Step S13).

When normal values are detected in Step S12, the rotational drive of the fixation roller 21 is started and power is supplied to the exciting coil 25 to start induction heating of the fixation roller 21 (Step S14).

During the heating of the fixation roller 21, the detection temperature T of the thermistor 28 is monitored (Step S5). When the detection temperature T reaches a target temperature (Fixation temperature) Ta, the induction heating is stopped (Step S16). After the sop of induction heating, when the detection temperature T of the thermistor 28 is lower than a predetermined temperature Tlow which is lower than the target temperature Ta (Step S17), the induction heating is restarted (Step S14). In an ordinary operation, the temperature of the fixation roller 21 is temperature-controlled to be kept at the target temperature (fixation temperature) Ta by repeating Steps S4 to S7 described above.

On the other hand, although the detection temperature T of the thermistor 28 is lower than the target temperature Ta ("YES" of Step S5), when such a detection that an AC input current Iin is lowered to a current value I1 is detected (Step S18), the main controller 100 judges that the recording sheet P is present in such a complete winding state that it is wound around the fixation roller 21 as shown in FIG. 7 (winding error) and then immediately stops the drive of the image forming apparatus. With respect to the fixing apparatus 20, the drive of the fixation roller 21 is stopped and the power supply to the exciting coil 25 is stopped by blocking the power supply to the fixation roller 21 by the power control circuit 104, thus stopping the electromagnetic induction heating of the fixation roller 21. The main controller 100 provides the user with such a notification that the recording sheet P is wound around the fixation roller 21 by displaying a massage to that effect on the display portion 8 of the console portion E (Step S19).

As described in Embodiments 1, 2 and 3 in detail, by detecting the occurrence of the winding of the recording sheet P around the fixation roller 21 (FIG. 7) on the basis of signals from the fixation temperature detection means 28 for detecting the temperature of the fixation roller 21 (induction heating element) and the Curie temperature reaching detection means 28 (Embodiment 1) or 106 (Embodiment 3) for detecting that the fixation roller temperature reaches the Curie temperature Tc, it is possible to detect the winding of the recording sheet P around the fixation roller 21, which has not been readily recognized by user's eye observation, even after the main switch of the image forming apparatus is turned off/on.

Further, the leakage magnetic flux is detected by using the magnetic coil 29 (Embodiment 1) as the Curie temperature reaching detection means, whereby it is possible to detect that the temperature of the fixation roller 21 reaches the Curie temperature in non-contact with the fixation roller 21 (which is the induction heating element) and without being affected by the wound recording sheet P. Further, it is also possible to detect the reaching to the Curie temperature with reliability.

Further, by utilizing the change in power factor at the time when the temperature of the fixation roller 21 (induction heating element) reaches the Curie temperature Tc, the reaching of the fixation roller temperature reaches the Curie temperature Tc is detected on the basis of the change in AC input current (Embodiment 2), so that it is possible to reduce a mounting error at the time of installation and it is not necessary to dispose parts in the neighborhood of the fixation roller. As a result, it becomes possible to perform the detection without concern for the life of parts.

Other Embodiments

1) The heating apparatus of the electromagnetic induction heating type according to the present invention is not limited to be used as the image heat-fixing apparatus as in the above described embodiment but is also effective as a provisional fixing apparatus for provisionally fixing an unfixed image on a recording sheet or an image heating apparatus such as a surface modification apparatus for modifying an image surface characteristic such as glass by reheating a recording sheet carrying thereon a fixed image. In addition, the heating apparatus of the present invention is also effective as a heating apparatus for heat-treating a sheet-like member, such as a hot press apparatus for removing rumples of bills or the like, a hot laminating apparatus, or a hot-drying apparatus for evaporating a moisture content of paper or the like.

2) The shape of the induction heating element is not limited to the roller shape but may be other rotational body shapes, such as an endless belt shape. The heating member may be constituted by not only a single induction heating member or a multilayer member having two or more layers including an induction heating layer and other material layers of heat-resistant plastics, ceramics, etc.

3) The induction heating scheme of the induction heating member (element) by the magnetic flux generation means is not limited to the internal heating scheme but may be an external heating scheme in which the magnetic flux generation means is disposed outside the induction heating member.

In order to obviate the non-sheet passing portion temperature rise which is liable to occur when the small-sized material to be heated is passed through the heating apparatus continuously, the image forming apparatus of the present invention may be provided with a magnetic flux blocking (adjusting) means such as a shutter member for blocking a part of magnetic flux acting from the magnetic flux generation means to the induction heating element.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 427809/2003 filed Dec. 24, 2003, which is hereby incorporated by reference.

What is claimed is:

1. An image forming apparatus, comprising:

magnetic flux generation means, a rotatable induction heating element for generating heat by the action of magnetic flux generated by said magnetic flux generation means, said induction heating element heating a material to be heated by contacting the material to be heated;

temperature detection means for detecting a surface temperature of said induction heating element;

energization control means for controlling energization to said magnetic flux generation means on the basis of an output from said temperature detection means so that a surface temperature of said induction heating element is a preliminarily set setting temperature;

Curie temperature reaching detection means for detecting that a temperature of said induction heating element reaches a Curie temperature; and abnormality detection means for detecting abnormality when said abnormality detection means detects, before said image forming apparatus is placed in an image formable state, that the surface temperature of said induction heating element has reached the Curie temperature before it reaches the setting temperature which is lower than the Curie temperature of said induction heating element.

2. An apparatus according to claim 1, wherein said image forming apparatus further comprises a display for displaying abnomality when said abnormality detection means detects abnormality.

3. An apparatus according to claim 1, wherein said Curie temperature reaching detection means is detection means for detecting leakage magnetic flux leaked from said heating element.

4. An apparatus according to claim 1, wherein said Curie temperature reaching detection means is means for measuring an input current.

* * * * *